US012460417B2

(12) United States Patent
Haber et al.

(10) Patent No.: US 12,460,417 B2
(45) Date of Patent: Nov. 4, 2025

(54) ADJUSTABLE GLASS WINDSCREEN SYSTEM

(71) Applicants: Jeff Haber, Upper Saddle River, NJ (US); Michael Awad, Robbinsville, NJ (US)

(72) Inventors: Jeff Haber, Upper Saddle River, NJ (US); Michael Awad, Robbinsville, NJ (US)

( * ) Notice: Subject to any disclaimer, the term of this patent is extended or adjusted under 35 U.S.C. 154(b) by 343 days.

(21) Appl. No.: 18/128,018

(22) Filed: Mar. 29, 2023

(65) Prior Publication Data

US 2023/0313537 A1 Oct. 5, 2023

Related U.S. Application Data

(60) Provisional application No. 63/324,677, filed on Mar. 29, 2022.

(51) Int. Cl.
*E04F 11/18* (2006.01)

(52) U.S. Cl.
CPC ..... *E04F 11/1812* (2013.01); *E04F 11/1853* (2013.01); *E04F 2011/1876* (2013.01)

(58) Field of Classification Search
CPC ..... E04F 11/1812; E04F 11/1851; E04F 11/1853; E04F 2011/1895
See application file for complete search history.

(56) References Cited

U.S. PATENT DOCUMENTS 4,054,268 A * 10/1977 Sher ..... E04F 11/1812 256/67
7,913,983 B1 * 3/2011 Sandor, Sr. ..... E04F 11/1812 256/60
9,752,327 B2 * 9/2017 Poradzisz ..... E06B 3/5454
10,184,267 B2 * 1/2019 Kuo ..... E04F 11/1812

FOREIGN PATENT DOCUMENTS

EP 3 892 791 * 10/2021 ..... E04F 11/1812

* cited by examiner

*Primary Examiner* — Michael P Ferguson
(74) *Attorney, Agent, or Firm* — David L. Nocilly; Bond Schoeneck & King PLLC

(57) ABSTRACT

An adjustable glass windscreen system including an elongate shoe secured atop a supporting surface with inner and outer vertical shoe walls journaled into a baseplate to define a track. A glass adjustment block is seated within the track of the shoe, likewise a three-walled open-top framing member defining a track. A glass panel is seated in the glass adjustment block. The width of the adjustment block is less than the track of the shoe to allow lateral adjustment. Buffer pads line the inside top edges of the opposing inner and outer shoe walls. Adjustment bolts are threaded through the inner and outer shoe walls and penetrate the bottom base of the glass adjustment block for back-and-forth adjustment thereof, and hence the glass panel seated therein. This cantilevers the glass panel about the buffer pads and amplifies the adjustment upward to the upper edge of the glass panel.

17 Claims, 4 Drawing Sheets

ADJUSTABLE GLASS WINDSCREEN SYSTEM

CROSS-REFERENCE TO RELATED APPLICATIONS

The present application claims priority from U.S. Provisional Patent Application No. 63/324,677 filed 29 Mar. 2022.

BACKGROUND OF THE INVENTION

1. Field of the Invention

The present invention relates generally to construction and, in particular, an improved glass windscreen system for buildings and residences.

2. Description of the Background

Glass windscreens/railings serve an important aesthetic and structural role in many building projects by adding support, safety, and style. They provide unobstructed rooftop views and wind protection for rooftop decks, pools, and gardens, and continue to grow in popularity as a result. For example, top-of-building outdoor observation decks in New York use windscreens to promote spectacular, unobstructed views of the city skyline, and the panoramic views bring significant tourist revenue.

Conventionally, tempered glass window panels are seated adjacent to each other in a track or shoe assembly and are secured in place, typically by grout or epoxy poured-in-place in the shoe. However, glass windscreens are very difficult to install. The typical height of a windscreen system is six (6) feet above the walking surface, but height may range from four feet (for residential applications) to fourteen feet (for large scale observation decks). Moreover, installation access is necessarily from one side only, and the machining tolerances of the tracks or clamps, combined with installation tolerances, are amplified by the height of the glass panels to sometimes results in substantial misalignments along the top edges. Moreover, once the epoxy sets there is no adjustability and removal or replacement becomes very difficult and dangerous.

What is needed is a glass panel support system capable of supporting very heavy glass panels side-by-side, and which simplifies installation and allows adjustment for proper alignment, as well as removal and/or replacement of the glass panels.

SUMMARY OF THE INVENTION

According to an embodiment of the invention, an adjustable glass windscreen system is disclosed that is capable of supporting very heavy glass panels side-by-side in an elongate shoe and which simplifies installation and allows adjustment of the glass panels for proper alignment, plus removal and/or replacement of the glass panels.

The adjustable glass windscreen system includes an elongate shoe secured atop a supporting surface, the shoe comprising an elongate baseplate with inner and outer vertical shoe walls parallel-spaced from each other and journaled into the baseplate to define a track. A glass adjustment block is seated within the track of the shoe. The glass adjustment block is a three-walled open-top framing member also defining a track. The width of the glass adjustment block is slightly less than the track spacing of the shoe between opposing inner and outer shoe walls. One or more framing buffer strips are seated in and conform to the interior track of the glass adjustment block for seating a glass panel therein. In addition, a pair of buffer pads run along the inside top edges of the opposing inner and outer shoe walls. A plurality of laterally-spaced adjustment bolts are threaded through the inner and outer shoe walls and penetrate the bottom base of the glass adjustment block. The adjustment bolts carry the glass adjustment block and are configured for back-and-forth adjustment of it, and hence the glass panel seated therein, within the inner and outer shoe walls. The adjustment cantilevers the glass panel about the buffer pads along the inside top edges of the opposing inner and outer shoe walls, and amplifies the adjustment upward along the glass panel to its distal upper edge. In addition, a plurality of spaced glass securement bolts penetrate both inner and outer shoe walls and the glass panel between adjustment bolts and buffer pads to prevent the glass panel from falling out.

Installation and adjustment can be accomplished from the inside of the inner shoe wall, causing the panels to cantilever about buffer pads so that the small degree of lateral adjustment is amplified at the top of the glass panels to compensate for substantial misalignments along the top edges. When the top edges are aligned the glass adjustment block is locked in place by the securement bolts.

The present invention is described in greater detail in the detailed description of the invention, and the appended drawings. Additional features and advantages of the invention will be set forth in the description that follows, will be apparent from the description, or may be learned by using the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

The present invention generally is an adjustable frameless glass windscreen system capable of supporting very heavy glass panels side-by-side in an elongate shoe, and which simplifies installation and allows adjustment of the glass panels for proper alignment. With combined reference to FIGS. 1-2, the adjustable frameless glass windscreen system 2 generally comprises a windscreen glass panel 10, fixedly anchored in an adjustable shoe 20. The dimensions of the glass panel 10 may vary as a matter of design choice and may be single or double pane glass panels of clear safety glass, preferably double-tempered-safety glass.

Figure 1:
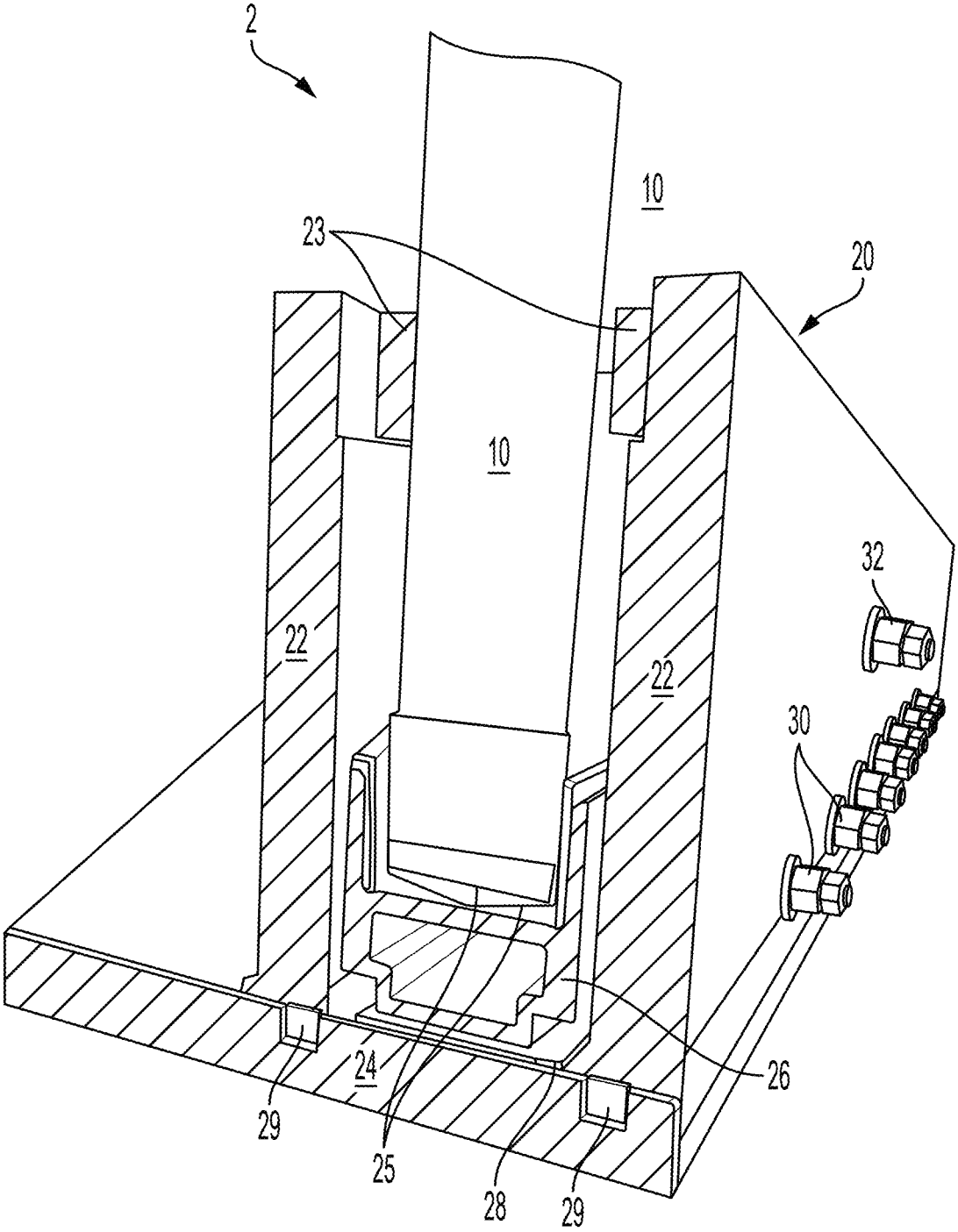
FIG. 1 is a perspective view of a glass windscreen with glass panel support system according to the present invention.

The adjustable shoe 20 comprises inner and outer parallel-spaced shoe walls 22 journaled into grooves 29 in baseplate 24, preferably by tongue-and-groove fit as shown to define a elongate shoe with interior track for seating a glass adjustment block 26. The inner and outer shoe walls 22 and baseplate 24 may be, for example, 1¼" stainless steel panels of dimensions shown in FIG. 2. The glass adjustment block 26 is carried within the interior track of the adjustable shoe 20 between inner and outer shoe walls 22 and atop baseplate 24. The glass adjustment block 26 is a unitary framing member that likewise comprises inner and outer parallel-spaced walls that define a elongate shoe with interior track for seating glass panel 10, all within the larger track of adjustable shoe 20. The glass adjustment block 26 may be formed of aluminum, for example, with spaced vertical walls for cradling the glass panel 10 and a reinforced bottom base to support the weight. The bottom base may be hollow as seen in FIG. 1 to conserve weight. The glass adjustment block 26 preferably rides atop a nylon strip 28 for material separation and to reduce friction, preferably a 1/16" thick nylon strip. Similarly, the windscreen glass panel 10 rides atop a nylon strip 25 for material separation, preferably a 1/16" thick nylon strip, and the strip 25 is seated inside a framing buffer 27, preferably formed of Delrin™ plastic or the like. Framing buffer 27 comprises a sock inserted endwise onto glass panel 10 with opposing foldover flaps that fold together about the end of glass panel 10. Alternatively, the framing buffer 27 may be a single U-shaped strip or two opposing L-shaped strips seated into and conforming to the interior track of the adjustable shoe 20. The windscreen glass panel 10 is centered within the adjustable shoe 20 and upwardly supported by a pair of buffer pads 23, preferably deformable silicon strips running along the inside top edges of the opposing inner and outer shoe walls 22. Importantly the width of the adjustable shoe 20 is slightly less than the spacing between opposing inner and outer shoe walls 22 leaving a lateral adjustment clearance.

As seen in FIGS. 1-4 a series of laterally-spaced adjustment bolts 30 penetrate both inner and outer shoe walls 22 of adjustable shoe 20 as well as the bottom base of glass adjustment block 26. The adjustment bolts 30 are installed into the opposing inner and outer shoe walls 22 and carry the glass adjustment block 26 there between, such that clockwise and counterclockwise turning of adjustment bolts 30, respectively, shifts the glass adjustment block 26 laterally back and forth between opposing inner and outer shoe walls, allowing a small degree of back-and-forth adjustment capability of glass panel 10 within inner and outer shoe walls 22.

Figure 2:
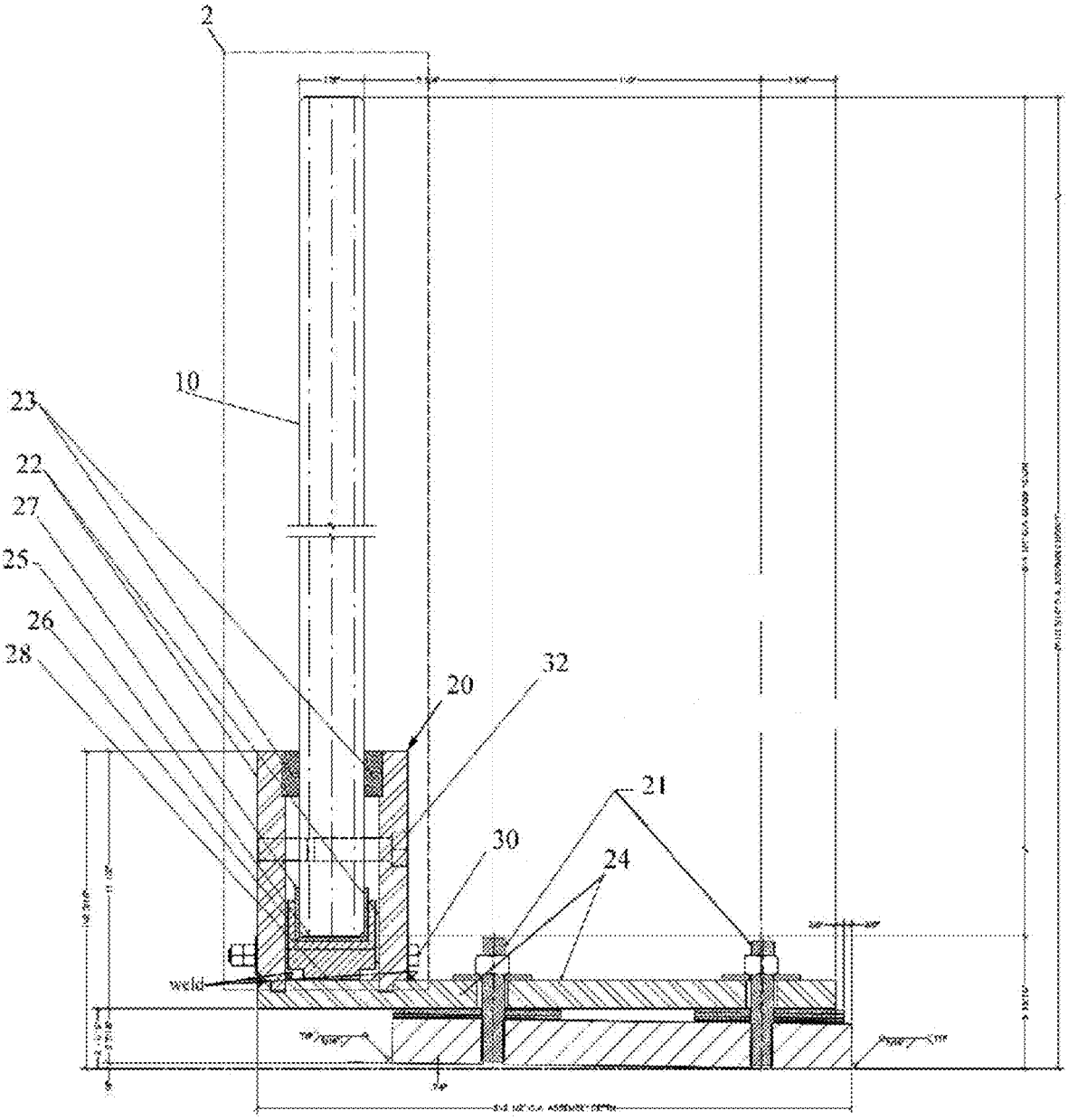
FIG. 2 is an end view cross-section of the glass windscreen with glass panel support system of FIG. 1.
Figure 4:
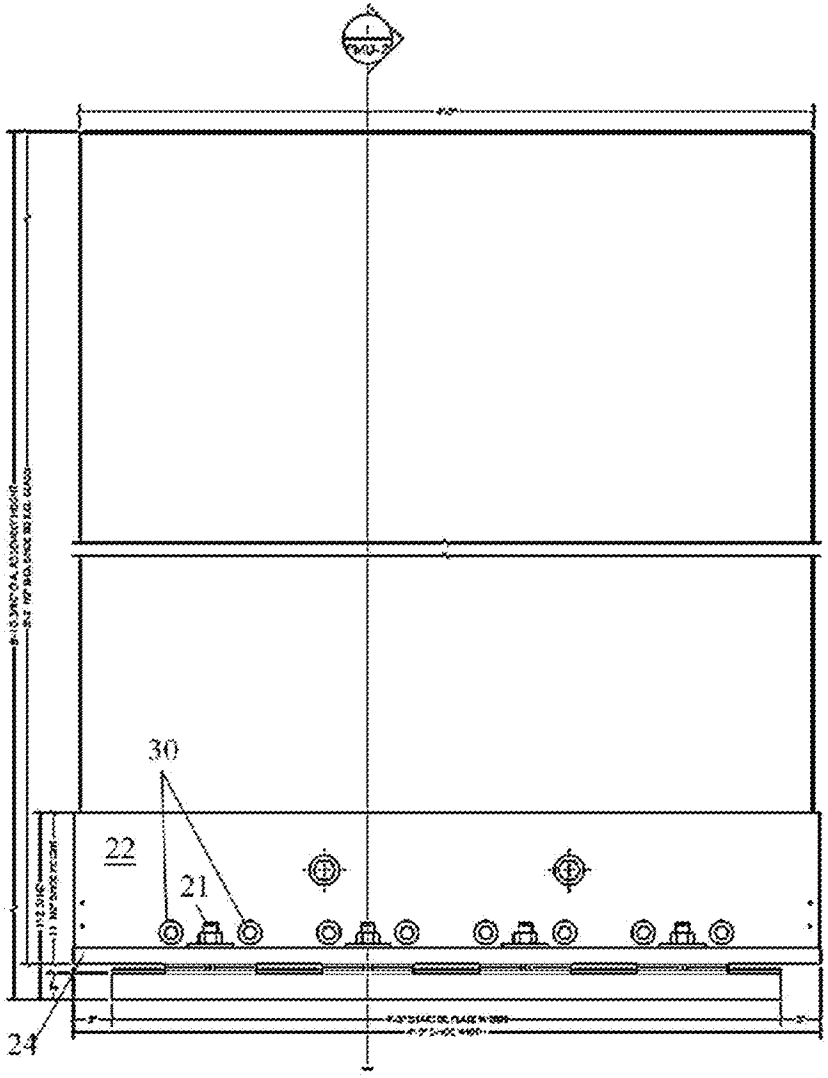
FIG. 4 is a top view of the adjustable shoe 20 of FIG. 3.
Figure 3:
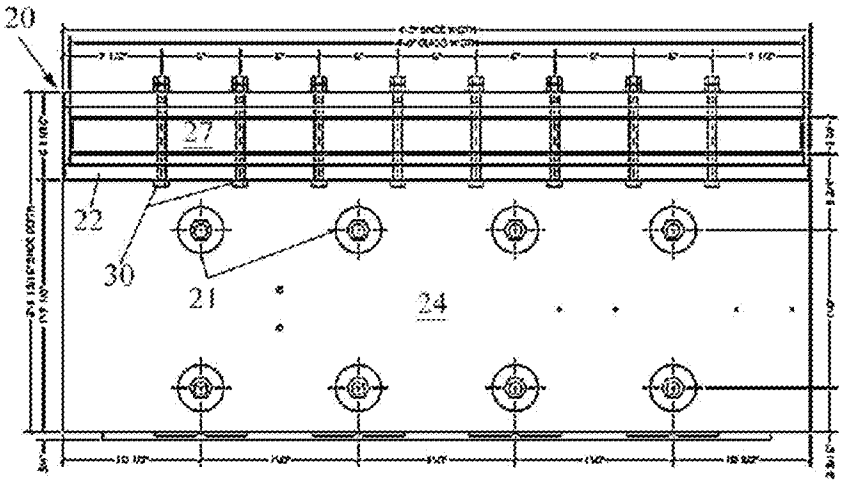
FIG. 3 is a side view of the adjustable shoe 20 of the glass panel support system of FIGS. 1-2.

As seen in FIGS. 1-2 the adjustment can be accomplished from the inside of the inner shoe wall 22, e.g., from the inside of the windscreen assembly 2, with the securement bolts 32 safely anchoring the glass panel 10 inside shoe 2 to prevent falling out. This fine adjustment causes the panels 10 to cantilever about buffer pads 23, so that the degree of adjustment is amplified at the top of the glass panels 10 to account for more substantial misalignments along the top edges. When the top edges are aligned the glass adjustment block 26 is locked in place by a double-nut outside the outer shoe wall 22. In addition to adjustment bolts 30, a series of laterally-spaced glass securement bolts 32 penetrate both inner and outer shoe walls 22 as well as the glass panels 10 approximately midway between adjustment bolts 30 and buffer pads 23. The heads of securement bolts 32 may be countersunk as shown in FIG. 2, and securement bolts 32 safely anchor the glass panel 10 inside shoe 20 and prevent falling out.

The base plate(s) 24 is/are secured to a supporting structure such as a floor. For example, the FIG. 2 shows a plurality of separate base plates 24 each clamped within screw-clamps 21 secured to an underlying floor, albeit the manner of attaching each shoe 20 to the underlying platform, flooring or surface may vary as a matter of design choice.

In practice, installation or assembly of a glass windscreen system 2 according to the present invention starts by securing a baseplate 24 with pre-machined grooves 29 to an underlying platform, flooring or other supporting surface. The inner and outer shoe walls 22 are inserted onto baseplate 24 with tongue-and-groove fit and are welded thereto at three points marked 'weld' in FIG. 2. Nylon strip 28 is inserted for material separation and to reduce friction, and glass adjustment block 26 is inserted in the track of the adjustable shoe 20 between inner and outer shoe walls 22 bearing atop strip 28 which in turn sits atop baseplate 24. The three-walled open-top framing buffer 27 is inserted into shoe 20. Nylon strip 25 is adhered along the end of glass panel 10, and framing buffer 27 is inserted endwise onto glass panel 10 and opposing foldover flaps are folded overtop strip 25 about the end of glass panel 10.

Figure 5:
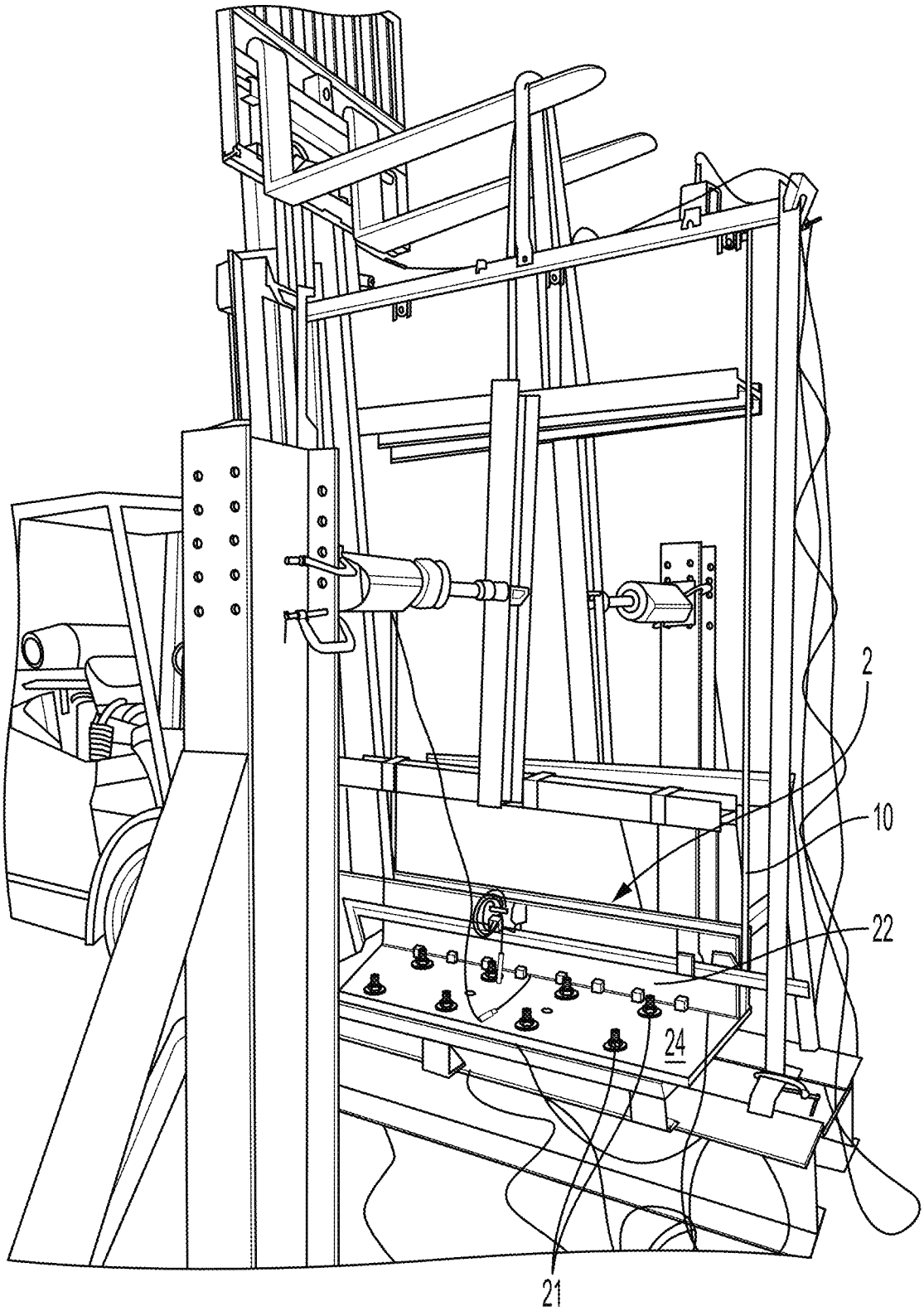
FIG. 5 is a perspective view of installation of the glass windscreen with glass panel support system of FIGS. 1-4.

As seen in FIG. 5 the windscreen glass panel 10 is brought to bear by a forklift of the like and is inserted into framing buffer 27. Buffer pads 23 are inserted, and the windscreen glass panel 10 is centered within the adjustable shoe 20 by buffer pads 23. The laterally-spaced adjustment bolts 30 are inserted loosely through both inner and outer shoe walls 22 as well as the bottom base of glass adjustment block 26, and securement bolts 32 are likewise loosely installed through both inner and outer shoe walls 22 as well as the glass panels 10 approximately midway between adjustment bolts 30 and buffer pads 23. Finally, the adjustment bolts 30 are adjusted to position the glass adjustment block 26 such that the upper edges of the glass panels 10 are perfectly aligned. Again, all the foregoing work including the adjustment can be accomplished from the inside of the windscreen assembly 2, with the securement bolts 32 safely anchoring the glass panel 10 inside shoe 20 to prevent falling out. Given proper alignment the double-nut adjustment bolts 30 and the adjustment bolts 30 are locked in place.

It should now be apparent that the above-described system differentiates itself from the industry as a mechanically installed glass windscreen system. It is easier, quicker and safer to install, uses no volatile or combustible epoxies or grout, and is easier to replace in the event of breakage.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. An adjustable frameless glass windscreen system for supporting a glass panel, comprising:

an adjustable shoe including inner and outer parallel-spaced shoe walls joined by a baseplate and defining an interior track;

a glass adjustment block carried within the interior track of the adjustable shoe between the inner and outer shoe walls and atop said baseplate, said glass adjustment block comprising an elongate member with inner and outer parallel-spaced walls separated by a base and defining an interior track for seating said glass panel;

a plurality of adjustment pins all inserted through both inner and outer shoe walls and threadably engaged through the base of the adjustment block such that clockwise and counterclockwise turning of the plurality of adjustment pins will shift the adjustment block laterally back and forth between the inner and outer shoe walls along threads on the adjustment pins, wherein said plurality of adjustment pins each comprise a bolt inserted through both inner and outer shoe walls and engaged through the base of the adjustment block, and a nut threaded onto said bolt.

2. The adjustable frameless glass windscreen system of claim 1, wherein the inner and outer parallel-spaced shoe walls include protruding tongues, and the baseplate includes a pair of parallel grooves, the tongues of said shoe walls being journaled in the grooves of the baseplate.

3. The adjustable frameless glass windscreen system of claim 1, wherein the interior track of the adjustable shoe is wider than the inner and outer parallel-spaced walls of the glass adjustment block.

4. The adjustable frameless glass windscreen system of claim 1, wherein the adjustment block is a unitary member.

5. The adjustable frameless glass windscreen system of claim 4, wherein the base of the adjustment block is hollow.

6. The adjustable frameless glass windscreen system of claim 1, further comprising a pair of resilient buffer pads running along the inside top edges of the inner and outer shoe walls.

7. The adjustable frameless glass windscreen system of claim 1, further comprising a buffer pad lining the interior track of the adjustable shoe between the inner and outer shoe walls.

8. The adjustable frameless glass windscreen system of claim 1, further comprising a buffer pad lining the interior track of the adjustment block.

9. The adjustable frameless glass windscreen system of claim 1, further comprising a second nut for locking said first nut.

10. The adjustable frameless glass windscreen system of claim 1, further comprising a glass panel seated in said adjustable shoe.

11. The adjustable frameless glass windscreen system of claim 10, further comprising a plurality of fixation pins inserted through both inner and outer shoe walls and engaged through the glass panel.

12. The adjustable frameless glass windscreen system of claim 11, wherein said plurality of fixation pins each comprise a bolt inserted through both inner and outer shoe walls and engaged through the glass panel, and a first nut threaded onto said bolt.

13. An adjustable glass windscreen system, comprising:

an elongate shoe secured atop a supporting surface, the shoe comprising inner and outer shoe walls parallely-spaced from each other and journaled into a baseplate to define a track;

a glass adjustment block carried within the track of the shoe, the glass adjustment block comprising an open-top framing member defining an interior track, a width of the glass adjustment block being less than the spacing between opposing inner and outer shoe walls;

a framing buffer seated in and conforming to the interior track of the adjustment block for seating a glass panel therein;

a pair of resilient buffer pads running along the inside top edges of the opposing inner and outer shoe walls;

a plurality of laterally-spaced adjustment bolts penetrating both of the inner and outer shoe walls and threadably engaging a bottom base of said glass adjustment block, the adjustment bolts being inserted through the opposing inner and outer shoe walls such that clockwise and counterclockwise turning of the plurality of laterally-spaced adjustment bolts will shift the glass adjustment block laterally back and forth between the inner and outer shoe walls along threads on the adjustment bolts and configured for back-and-forth adjustment of the glass panel within the inner and outer shoe walls, with each of the laterally-spaced adjustment bolts having a nut threaded onto such laterally-spaced adjustment bolt; and a plurality of spaced glass securement bolts penetrating both inner and outer shoe walls and the glass panel between the adjustment bolts and buffer pads to prevent the glass panel from falling out.

14. The adjustable frameless glass windscreen system of claim 13, wherein the inner and outer parallely-spaced shoe walls include protruding tongues, and the baseplate includes a pair of parallel grooves, the tongues of said shoe walls being journaled in the grooves of the baseplate.

15. The adjustable frameless glass windscreen system of claim 13, wherein the glass adjustment block is a unitary member.

16. The adjustable frameless glass windscreen system of claim 15, wherein the bottom base of the glass adjustment block is hollow.

17. The adjustable frameless glass windscreen system of claim 13, further comprising a buffer pad lining the interior track of the adjustable shoe between the inner and outer shoe walls.

* * * * *